US009801447B2

(12) United States Patent
Nunez

(10) Patent No.: US 9,801,447 B2
(45) Date of Patent: Oct. 31, 2017

(54) DISPENSER ADAPTER FOR PRESSURIZED FLUENT MATERIAL

(71) Applicant: Stephen Nunez, Frisco, TX (US)

(72) Inventor: Stephen Nunez, Frisco, TX (US)

( * ) Notice: Subject to any disclaimer, the term of this patent is extended or adjusted under 35 U.S.C. 154(b) by 16 days.

(21) Appl. No.: 14/948,234

(22) Filed: Nov. 20, 2015

(65) Prior Publication Data

US 2017/0143093 A1 May 25, 2017

(51) Int. Cl.
*B65D 83/00* (2006.01)
*A45D 19/02* (2006.01)
*A45D 19/00* (2006.01)

(52) U.S. Cl.
CPC ..... *A45D 19/02* (2013.01); *A45D 2019/0066* (2013.01)

(58) Field of Classification Search
CPC ..... A45D 19/02; A45D 2019/025; A45D 2019/0066
USPC ..... 222/402.1, 402.13, 402.15, 402.17, 222/402.21–402.25
See application file for complete search history.

(56) References Cited

U.S. PATENT DOCUMENTS 3,138,331 A * 6/1964 Kutik ..... B65D 83/206 222/182
3,648,905 A * 3/1972 Kauder ..... B65D 83/20 222/153.11
5,549,226 A * 8/1996 Kopp ..... B65D 83/303 222/402.13
D421,571 S * 3/2000 Kilian ..... D7/392
6,494,349 B1 * 12/2002 Thompson ..... B65D 83/206 222/310
6,637,627 B1 * 10/2003 Liljeqvist ..... B65D 83/201 222/151
D501,538 S * 2/2005 Zeng ..... D23/226
7,641,079 B2 * 1/2010 Lott ..... B65D 83/22 222/153.07
8,528,794 B2 * 9/2013 Wolf ..... B65D 83/201 222/402.13
9,079,675 B2 * 7/2015 Vervoort ..... B65D 83/201
2007/0181610 A1 * 8/2007 Fazekas ..... B65D 83/201 222/402.11

* cited by examiner

*Primary Examiner* — Lien Ngo
(74) *Attorney, Agent, or Firm* — Mark Tremblay

(57) ABSTRACT

A device for dispensing a viscous fluent material from a pressurized container may include an inner cylindrical wall having a length and a radius and defining a central conduit. The inner cylindrical wall defines first and second circular openings at first and second ends of the central conduit respectively. The first opening may be adapted in size and shape to engage a hollow cylindrical valve stem from a pressurized dispenser of viscous fluent material. The second opening may be adapted to dispense said viscous fluent material. At least one extension may be affixed to the inner cylindrical wall and extend radially with respect to the cylindrical inner wall. The extension may be adapted to transmit finger and hand pressure to the inner cylindrical wall.

17 Claims, 7 Drawing Sheets

DISPENSER ADAPTER FOR PRESSURIZED FLUENT MATERIAL

BACKGROUND

The invention relates broadly to fluent material dispensers, and in particular, to dispensers of viscous hair coloring.

In the hair care industry, hair coloring is both highly popular and expensive. Numerous vendors have hair color products available in a number of different containers. Some vendors provide hair color in pressurized containers which dispense a viscous foam or gel. These containers may be used by professional hair stylists who will pay a premium for a product that has a great brand name and provides great results.

Some vendors attempt to lock hairstylists into using their products and accessories by using proprietary dispensing apparatus. These proprietary dispensing apparatus may be designed to serve the vendor's interests rather than the interests of hair stylists. For example, they may be designed to induce the stylist to make repeated purchases by wasting the product. They may require additional steps to prepare the product. While the amount of waste may not be large, it may be a significant expense to a stylist who performs hundreds or even thousands of coloring sessions per year.

SUMMARY

A device for dispensing a viscous fluent material from a pressurized container may include an inner cylindrical wall having a length and a radius and defining a central conduit. The inner cylindrical wall defines first and second circular openings at first and second ends of the central conduit respectively. The first opening may be adapted in size and shape to engage a hollow cylindrical valve stem from a pressurized dispenser of viscous fluent material. The second opening may be adapted to dispense said viscous fluent material. At least one extension may be affixed to the inner cylindrical wall and extend radially with respect to the cylindrical inner wall. The extension may be adapted to transmit finger and hand pressure to the inner cylindrical wall. The extension may include a hub portion centered concentrically on the cylindrical inner wall. The extension may further include one or more handle portions extending radially from the inner cylindrical wall and attached to the hub portion.

DETAILED DESCRIPTION

Figure 1:
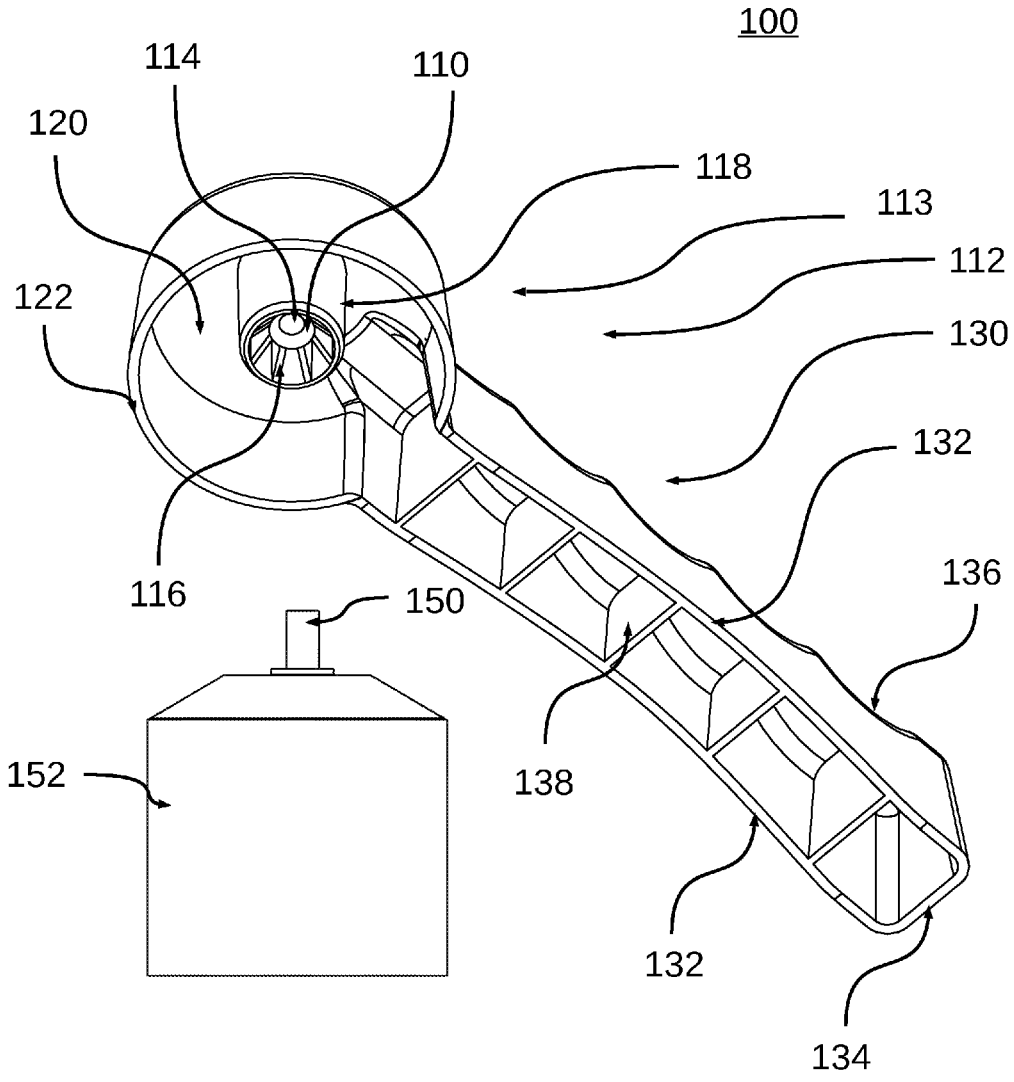
FIG. 1 illustrates a perspective view of an embodiment of a device for dispensing viscous fluent material.

FIG. 1 illustrates a perspective view of an embodiment of a device for dispensing viscous fluent material, for example hair colorant, showing the sides and bottom of the device. The device may include an inner cylindrical wall 110 and an extension 112 affixed to the inner cylindrical wall and extending radially with respect to the cylindrical inner wall. The extension 112 is adapted to transmit finger and hand pressure to the inner cylindrical wall. The extension 112 may include a hub portion 113 and a handle portion 130. The hub portion 113 may be formed concentrically around the inner cylindrical wall 110 to structurally support said inner cylindrical wall 110. The handle portion 130 may be attached to the hub portion. The handle portion may be adapted to conform to a human hand and transmit finger and hand pressure successively to the hub and the inner cylindrical wall 110. The inner cylindrical wall 110 has first and second circular openings at each end, defining a central conduit 114 adapted to dispense the contents of pressurized dispenser of viscous fluent material 152 by engaging hollow cylindrical valve stem 150.

The hub portion 113 of extension 112 may also include two or more support walls 116 attached to the inner cylindrical wall 110 and extending radially therefrom. Support walls 116 may be attached to a middle cylindrical wall 118. The middle cylindrical wall 118 may be formed concentrically with the inner cylindrical wall 110. The inner cylindrical wall 110 may be shorter than the middle cylindrical wall 118. The length of each of the at least two support walls may be longer adjacent to the middle cylindrical wall 118, and shorter adjacent the inner cylindrical wall 110. Ends or edges of each of the support walls 116 may be sloped between the inner cylindrical wall 110 and the middle cylindrical wall 118, thereby forming a guide for the hollow cylindrical valve stem 150.

The middle cylindrical wall 118 may be further attached to an end wall 120. End wall 120 may be further attached to the inner cylindrical wall 110 about the second circular opening. End wall 120 may be further attached to ends of the support walls 116 and an end of middle cylindrical wall 118. An outer cylindrical wall 122 may be attached to the end wall 120. The outer cylindrical wall 122 may be formed concentrically with the inner cylindrical wall 110 and the middle cylindrical wall 118.

The handle portion 132 of the extension 112 may include two side walls 132 and end wall 134 which together define a length of the handle portion 132. Side walls 132 may be attached to the outer cylindrical wall 122 and to the end wall 120 of the hub portion 113. The handle portion may be shaped to include one or more grooves 136, wherein each groove is sized to accommodate one human finger. Handle portion may also include structural reinforcement walls 138 generally parallel with end wall 134 to strengthen the handle portion 132.

Figure 2:
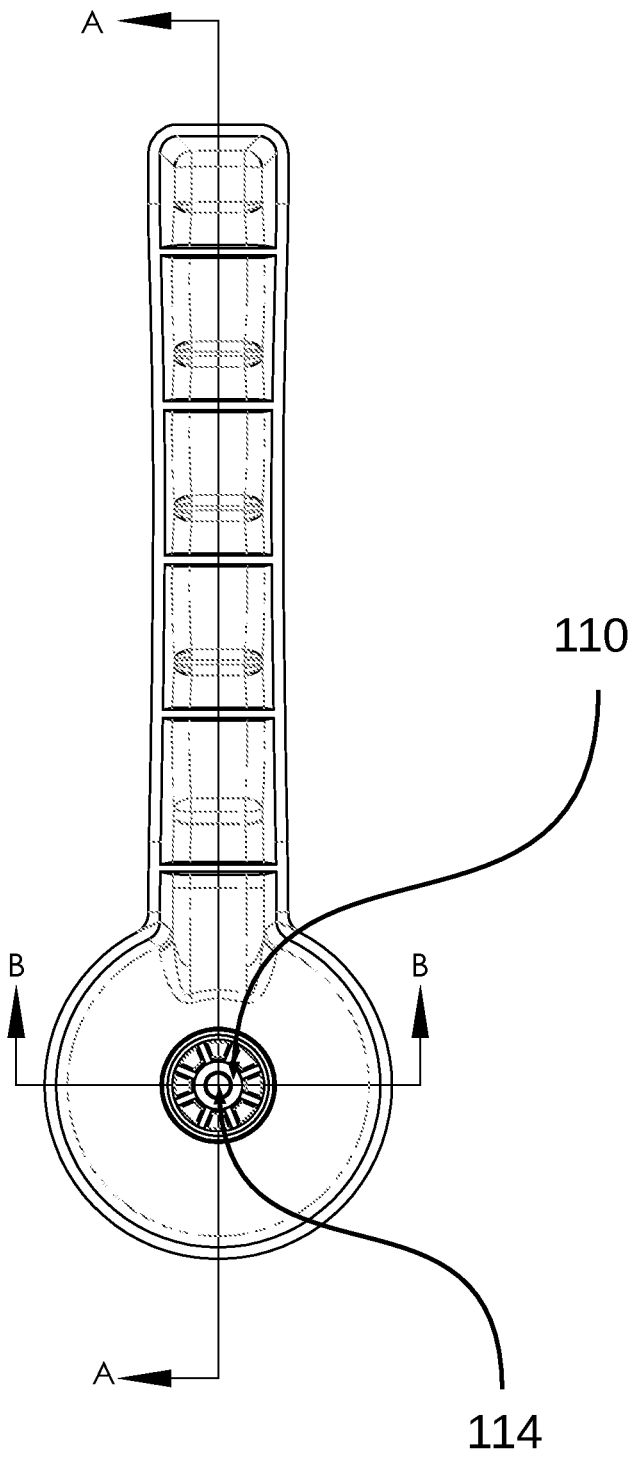
FIG. 2 shows a bottom view of an embodiment of a device for dispensing viscous fluent material.

FIG. 2 shows a bottom view of an embodiment of a device for dispensing viscous fluent material. Cross sectional lines A-A and B-B define the views in FIGS. 3 and 4 respectively. The intersection of cross sectional lines A-A and B-B is coincident with the center of conduit 114, as defined by inner cylindrical wall 110.

Figure 3:
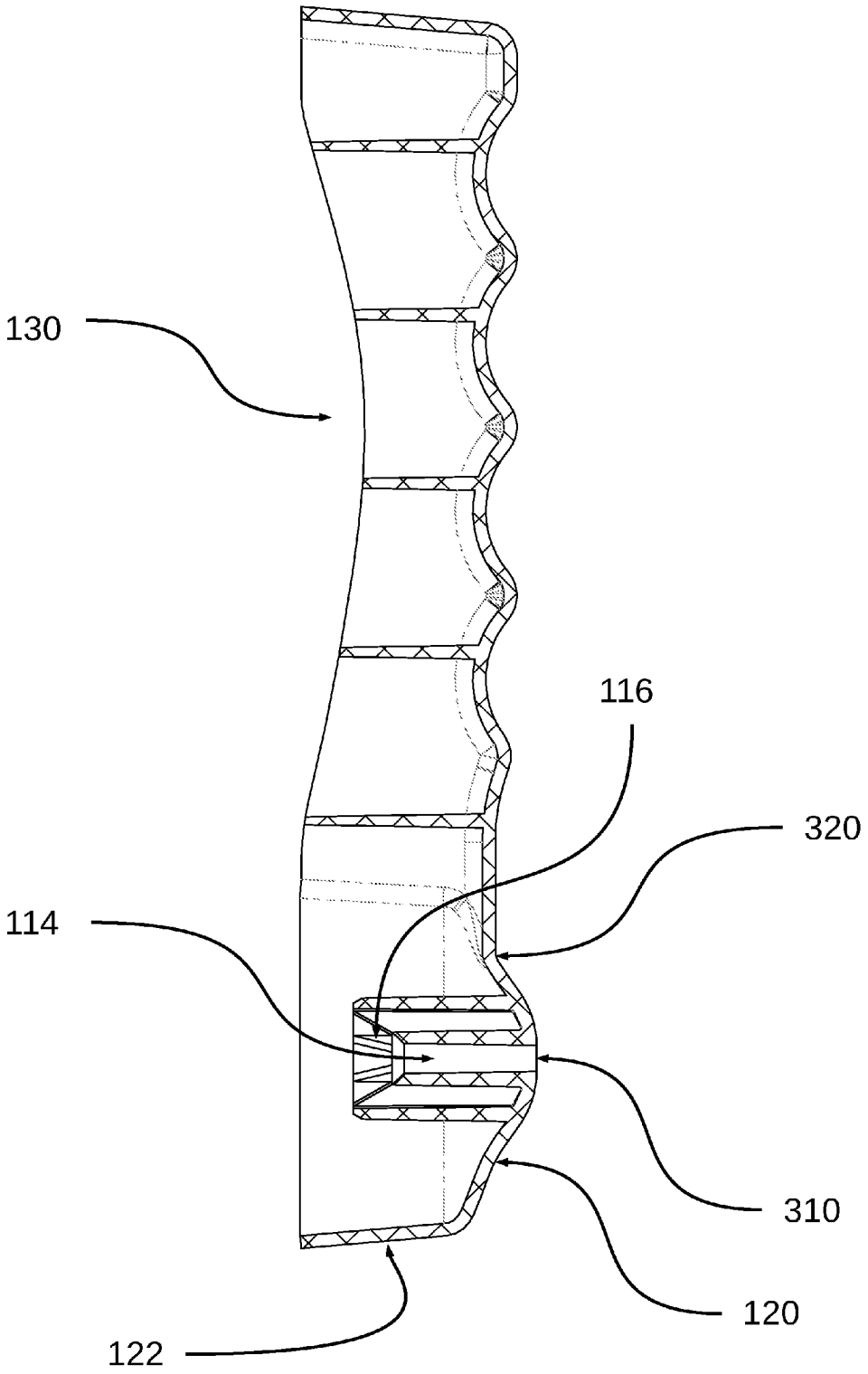
FIG. 3 shows a cross sectional view of an embodiment of the device for dispensing viscous fluent material along line A-A as shown in FIG. 2.

FIG. 3 shows a cross sectional view of an embodiment of the device for dispensing viscous fluent material along line A-A as shown in FIG. 2. The end wall 120 has a pierced conical shape defining a pierced vertex 310 and an outer edge portion 320, with the vertex 310 of the cone pierced coincident with the second opening of the conduit 114, and an outer edge portion 320 of the cone may be attached to the outer cylindrical wall 122 and the handle portion 130. Sloping edges of support walls 116 may be seen more clearly in FIG. 3.

Figure 4:
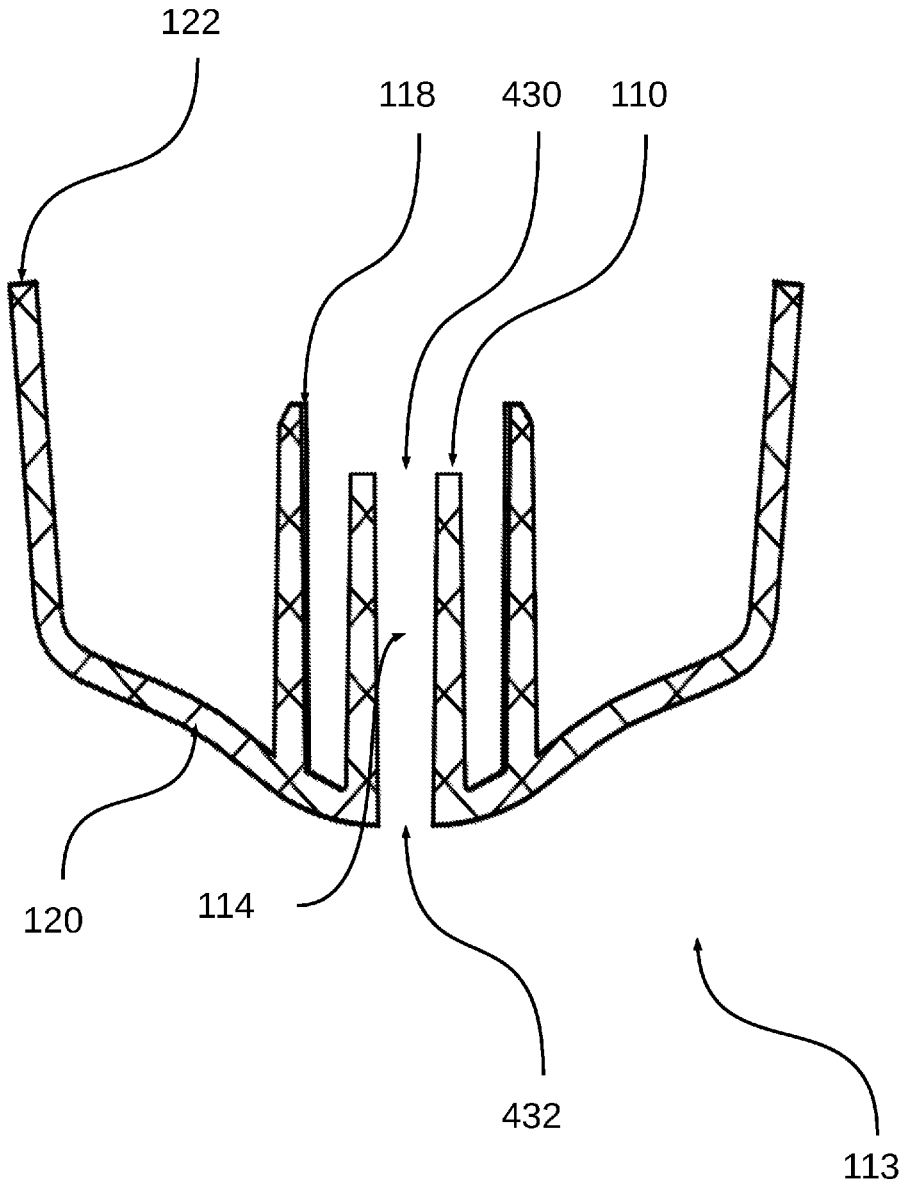
FIG. 4 shows a cross sectional view of an embodiment of the device for dispensing viscous fluent material along line B-B as shown in FIG. 2.

FIG. 4 shows a cross sectional view of an embodiment of the device for dispensing viscous fluent material along line B-B as shown in FIG. 2. The cross section illustrates inner cylindrical wall 110 and hub portion 113. The inner cylindrical wall 110 has first circular opening 430 and second circular opening 432 at each end, defining a central conduit 114 adapted to dispense the contents of pressurized dispenser of viscous fluent material 152 by engaging hollow cylindrical valve stem 150 (see FIG. 1).

As shown, the middle cylindrical wall 118 may be formed concentrically with the inner cylindrical wall 110. The inner cylindrical wall 110 may be shorter than the middle cylindrical wall 118. The end wall 120 has a pierced conical shape defining a pierced vertex coincident with second opening 432. As shown, the inner cylindrical wall 110 is adapted to pass viscous fluent material without a substantial narrowing restriction in the central conduit 114. In other words, the inner cylindrical wall 110 has a substantially constant radius along the length of the inner cylindrical wall, from the first opening 430 to the second opening 432. Alternatively, the inner cylindrical wall has a substantially constant radius along the length of the inner cylindrical wall, with the exception of a region near the first opening 430, where the radius is widened slightly to create a friction fit with the hollow cylindrical valve stem.

Figure 5:
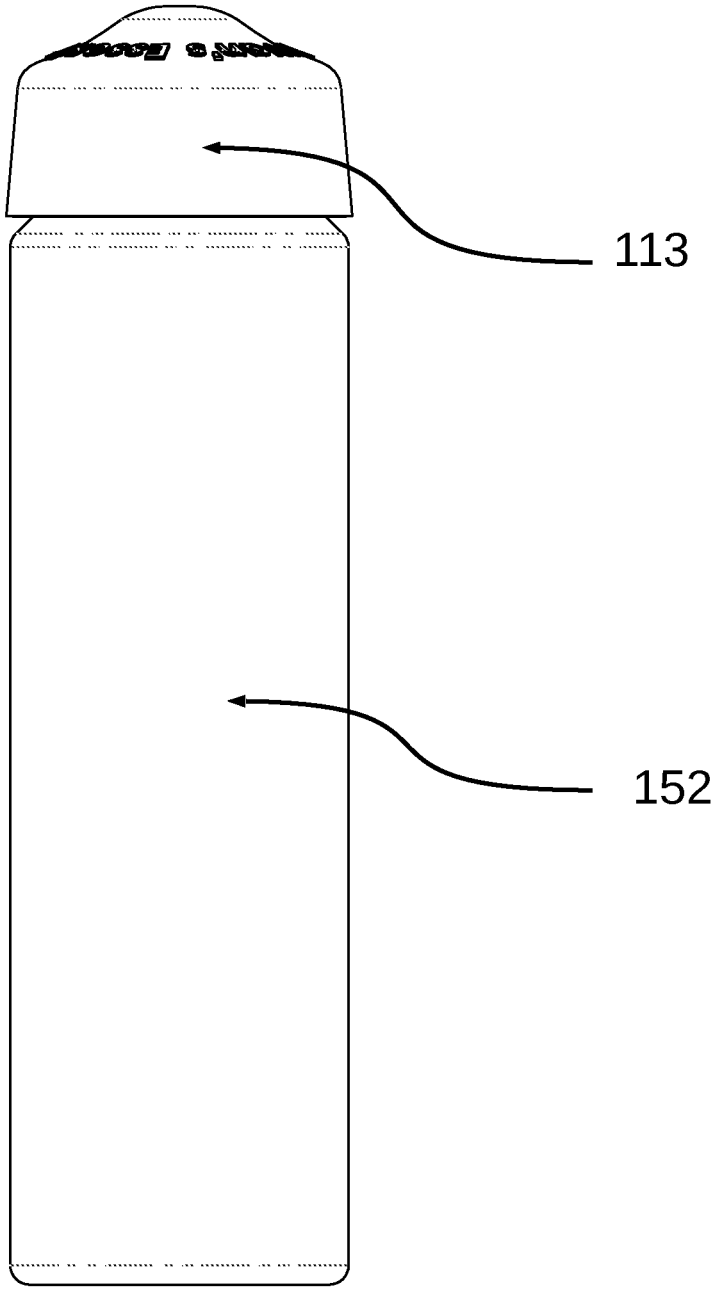
FIG. 5 shows a side view of an embodiment of a device for dispensing viscous fluent material placed on a pressurized container of fluent material.

FIG. 5 shows a side view of an embodiment of a device for dispensing viscous fluent material placed on a pressurized container of fluent material. As shown, the hub portion 113 of the extension fits over the pressurized dispenser 152.

Figure 6:
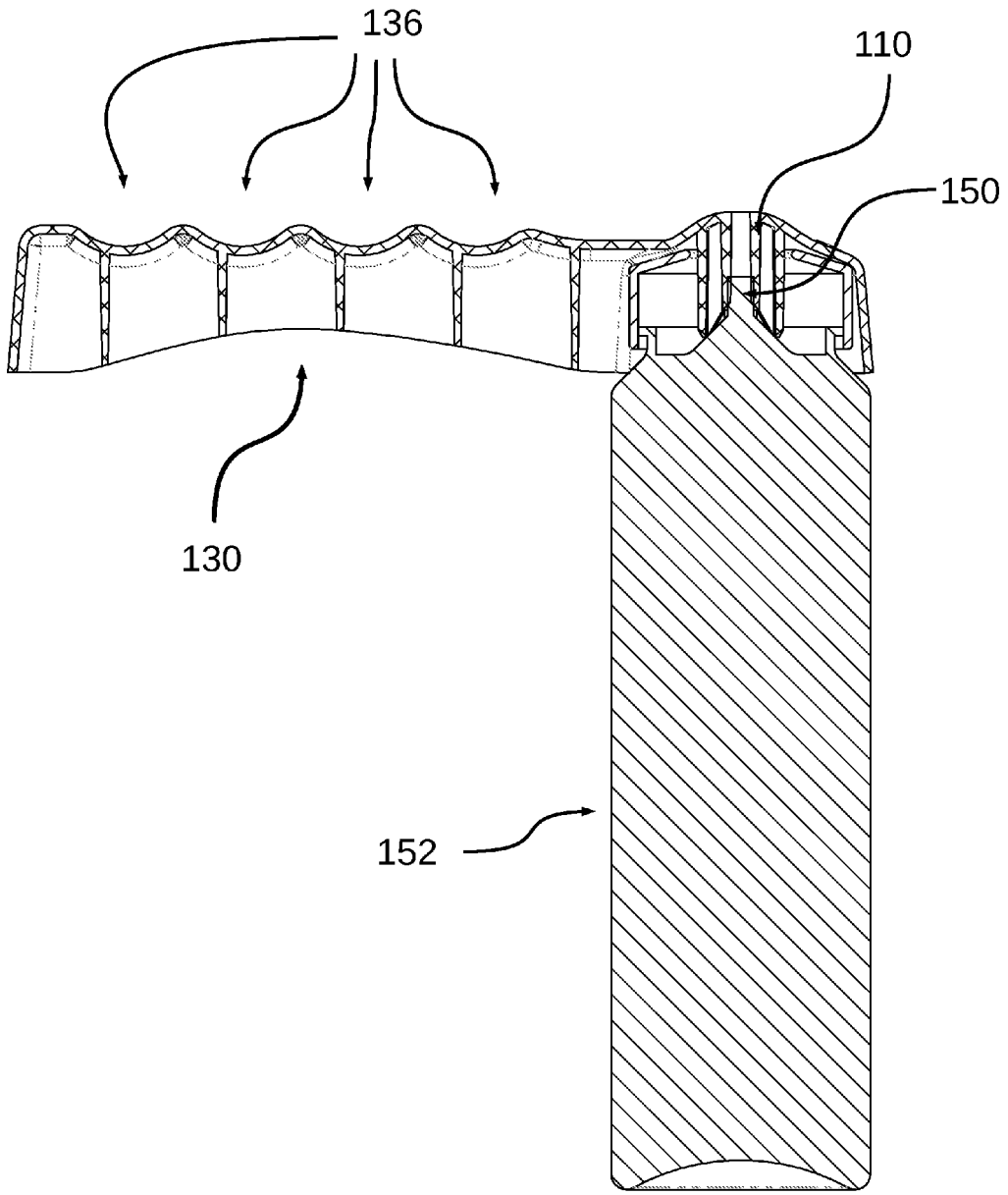
FIG. 6 shows an alternative cross sectional side view of an embodiment of a device for dispensing viscous fluent material placed on a pressurized container of fluent material.

FIG. 6 shows an alternative cross sectional side view of an embodiment of a device for dispensing viscous fluent material placed on a pressurized container of fluent material. Here, the hub portion of the extension is shown fitting over the pressurized dispenser. Handle portion 130 is attached to the hub portion, and extends radially out therefrom, providing a location to grip the device by hand, by placing fingers in groves 136, and by applying pressure to the inner cylindrical wall 110. The inner cylindrical wall depresses valve stem 150, which opens a valve in the pressurized dispenser 152 to release the pressurized contents therefrom.

Figure 7:
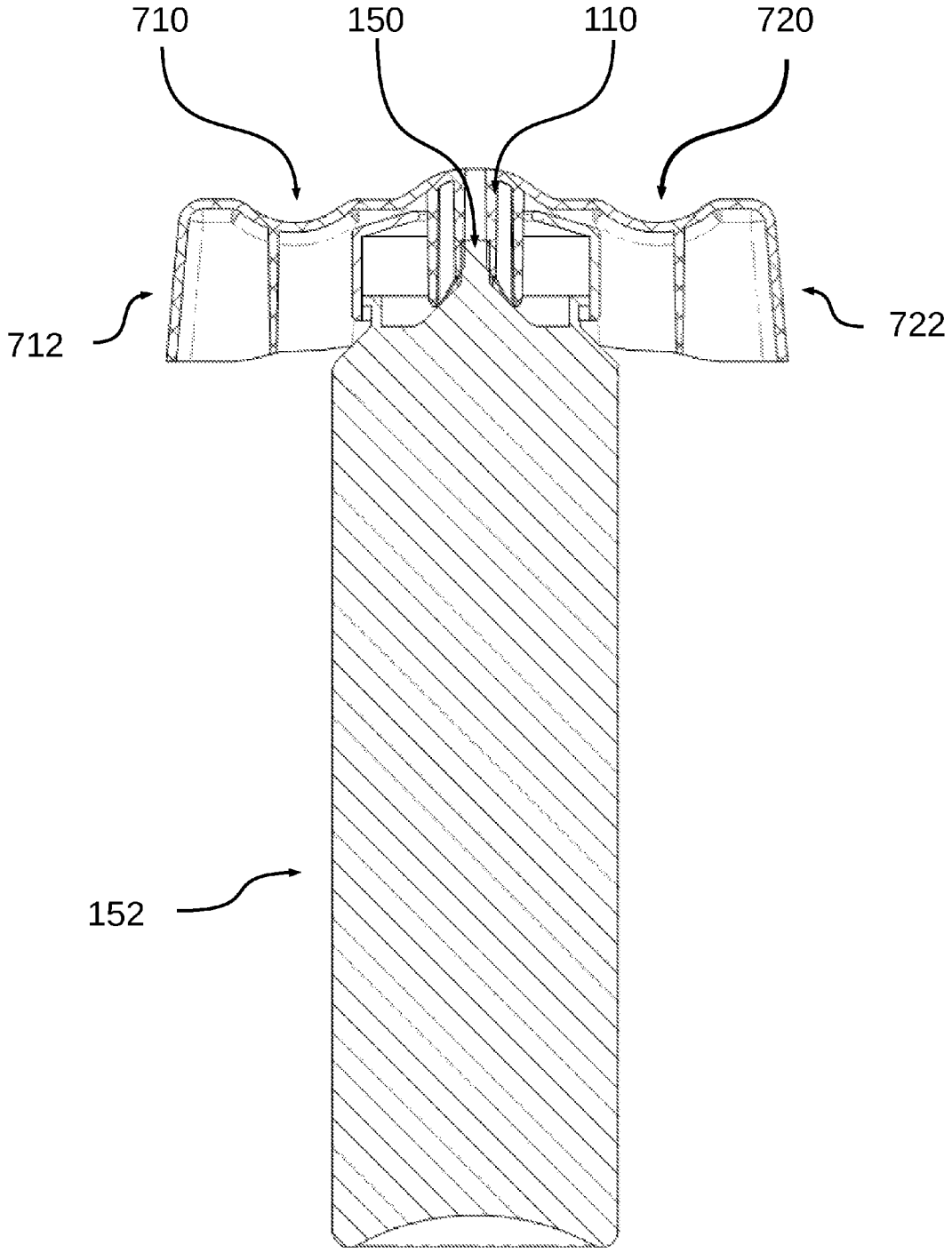
FIG. 7 shows an alternative cross sectional side view of an embodiment of a device for dispensing viscous fluent material placed on a pressurized container of fluent material.

FIG. 7 shows an alternative cross sectional side view of an embodiment of a device for dispensing viscous fluent material placed on a pressurized container of fluent material. Here, the hub portion of the extension is shown fitting over the pressurized dispenser. A first handle portion 710 is attached to the hub portion, and extends radially out therefrom, providing a location to grip the device with a first finger, by placing the first finger in groves 712, and by applying pressure to the inner cylindrical wall 110. A second handle portion 720 is attached to the hub portion, and extends radially out therefrom, providing a location to grip the device with a second finger, by placing the second finger in grove 722, and by applying pressure to the inner cylindrical wall 110. The inner cylindrical wall depresses valve stem 150, which opens a valve in the pressurized dispenser 152 to release the pressurized contents therefrom.

The invention claimed is:

1. A device, comprising:

an inner cylindrical wall having a length and a radius and defining a central conduit, the inner cylindrical wall defining first and second circular openings at first and second ends of the central conduit respectively, the first opening adapted in size and shape to engage a hollow cylindrical valve stem from a pressurized dispenser of viscous fluent material, and the second opening adapted to dispense said viscous fluent material; and at least one extension affixed to the inner cylindrical wall and extending radially with respect to the cylindrical inner wall, the extension adapted to transmit finger and hand pressure to the inner cylindrical wall, wherein the extension includes:

an end wall attached to the inner cylindrical wall at the second opening;

at least two support walls attached to the inner cylindrical wall and extending radially therefrom; and a middle cylindrical wall attached to the at least two support walls and wherein the middle cylindrical wall is further attached to the end wall.

2. The device according to claim 1, wherein the inner cylindrical wall is adapted to pass viscous fluent material without a substantial narrowing restriction in the central conduit.

3. The device according to claim 1, wherein the middle cylindrical wall is concentric with the inner cylindrical wall.

4. The device according to claim 1, wherein the inner cylindrical wall is shorter than the middle cylindrical wall, and a length of each of the at least two support walls is longer adjacent to the middle cylindrical wall, and shorter adjacent the inner cylindrical wall.

5. The device according to claim 4, wherein end walls of each of the at least two support walls are sloped between the inner cylindrical wall and the middle cylindrical wall, thereby forming a guide for the hollow cylindrical valve stem.

6. The device according to claim 1 wherein the extension includes an outer cylindrical wall attached to the end wall and to the handle portion.

7. The device according to claim 5 wherein the end wall has a pierced conical shape defining a pierced vertex and an outer edge portion, with the vertex of the cone pierced coincident with the second opening, and the outer edge portion of the cone is attached to the outer cylindrical wall and the handle portion.

8. The device according to claim 1 wherein the handle portion has a plurality of grooves, wherein each groove is sized and adapted to receive one human finger.

9. The device according to claim 8, wherein the handle portion contains two side walls, a top wall, an end wall, and a plurality of support walls connected between the two side walls.

10. The device according to claim 1, wherein the inner cylindrical wall has a substantially constant radius along the length of the inner cylindrical wall, from the first opening to the second opening.

11. The device according to claim 1, wherein the inner cylindrical wall has a substantially constant radius along the length of the inner cylindrical wall, with the exception of a region near the second opening, where the radius is adapted to create a friction fit with the hollow cylindrical valve stem.

12. The device according to claim 1, wherein the extension contains two opposed handle portions.

13. The device according to claim 12, wherein the two handle portions each have a grove contoured to accommodate at least one human finger.

14. A device for dispensing hair color from a pressurized container of hair color having a hollow cylindrical valve stem, comprising:

an inner cylindrical wall having a length and a radius and defining a central conduit having a substantially constant radius along the length of the conduit, the inner cylindrical wall defining first and second circular openings at first and second ends of the central conduit respectively, the first opening configured in size and shape to engage a hollow cylindrical valve stem from a pressurized dispenser of viscous hair color, and the second opening configured to dispense said hair color, wherein the inner cylindrical wall has a substantially constant radius along the length of the inner cylindrical wall, from the first opening to the second opening; and at least one extension affixed to the inner cylindrical wall and extending radially with respect to the cylindrical inner wall, the extension adapted to transmit finger and hand pressure to the inner cylindrical wall, wherein the extension includes:

an end wall attached to the inner cylindrical wall at the second opening;

at least two support walls attached to the inner cylindrical wall and extending radially therefrom; and a middle cylindrical wall attached to the at least two support walls and wherein the middle cylindrical wall is further attached to the end wall.

15. The device according to claim 14, wherein the extension includes:

at least one handle portion attached to the end wall, the handle portion having a plurality of grooves, wherein each groove is sized and adapted to receive one human finger;

wherein the middle cylindrical wall is concentric with the inner cylindrical wall and further wherein the inner cylindrical wall is shorter than the middle cylindrical wall, and a length of each of the at least two support walls is longer adjacent to the middle cylindrical wall, and shorter adjacent the inner cylindrical wall, and further wherein end walls of each of the at least two support walls are sloped between the inner cylindrical wall and the middle cylindrical wall, thereby forming a guide for the hollow cylindrical valve stem.

16. The device according to claim 15 wherein the extension includes an outer cylindrical wall attached to the end wall and to the handle portion, and wherein the end wall has a pierced conical shape defining a pierced vertex and an outer edge portion, with the vertex of the cone pierced coincident with the second opening, and the outer edge portion of the cone is attached to the outer cylindrical wall and the handle portion.

17. The device according to claim 16, wherein the handle portion contains two side walls, a top wall, an end wall, and a plurality of support walls connected between the two side walls.

* * * * *